US007021784B2

(12) United States Patent
DiCarlo

(10) Patent No.: US 7,021,784 B2
(45) Date of Patent: Apr. 4, 2006

(54) ARCHERS FLAME ILLUMINATED ARROW NOCK

(76) Inventor: Joseph L. DiCarlo, 7 Picket Ter., Wheeling, WV (US) 26003

( * ) Notice: Subject to any disclaimer, the term of this patent is extended or adjusted under 35 U.S.C. 154(b) by 153 days.

(21) Appl. No.: 10/763,117

(22) Filed: Jan. 22, 2004

(65) Prior Publication Data

US 2004/0184274 A1 Sep. 23, 2004

Related U.S. Application Data

(60) Provisional application No. 60/442,108, filed on Jan. 23, 2003.

(51) Int. Cl.
*F21V 33/00* (2006.01)

(52) U.S. Cl. ..... 362/109; 362/253

(58) Field of Classification Search ..... 362/109, 362/110, 204, 203
See application file for complete search history.

(56) References Cited

U.S. PATENT DOCUMENTS 4,340,930 A * 7/1982 Carissimi ..... 362/204
5,134,552 A * 7/1992 Call et al. ..... 362/203

* cited by examiner

*Primary Examiner*—Renee Luebke
*Assistant Examiner*—Zahra I. Bennett

(57) ABSTRACT

An archery arrow including conventional components such as a tubular shaft, a pointed head attached to the forward end of the shaft, fletching on the rearward portion of the shaft and a nock at the rear end of the shaft. The arrow structure also includes an illuminated nock of the present invention and includes a battery/switch/collar/L.E.D-combined unit, which is held in place by a single anchor pin with the L.E.D. portion of the battery inside a conventional translucent or clear nock. The arrow shaft also uses a wooden dowel or other like material to create a backstop and cushion within the arrow shaft. This may also be permanently constructed as part of the arrow shaft during manufacturing. This helps disperse the load generated from the strings forward motion when released from the bow in a full drawn position between the end cap and the entire battery and switch assembly. Upon shooting the arrow from a longbow, compound, or crossbow, the switch contacts are forced into the "closed switch" position by the forward force generated along the axis of the arrow shaft. Therefore, energizing the L.E.D. light source to give off light through the translucent or clear nock. Once shot and activated it's a simple matter of removing the nock from the shaft pulling rearward on the battery while holding the nock in a stationary position to turn the LED off. With this configuration of components said lighted nock can be dislodged from the arrow shaft and still remain in the lighted position. This invention is also reusable by turning said nock off and reinserting the nock back into the arrow shaft and shooting again. I have also made and tested a working prototype.

2 Claims, 5 Drawing Sheets

ARCHERS FLAME ILLUMINATED ARROW NOCK

CROSS-REFERENCE TO RELATED APPLICATIONS

I claim the benefits of the earlier filing date Jan. 23, 2003 of Provisional Patent Application No. 60/442,108.

FEDERALLY SPONSORED RESEARCH

Not Applicable

SEQUENCE LISTING OR PROGRAM

Not Applicable

BACKGROUND OF THE INVENTION

1. Field of Invention

The field of endeavor that this invention pertains to is archery hunting, with the specific subject matter pertaining to arrows and more specifically to one part of the arrow, the nock or insert located at the rearward most part of the arrow.

Most hunting is done during low light levels when game is most active in wilderness areas characterized by dense foliage and trees. On shooting archery arrows, there is extreme difficulty in visually tracking the flight of an arrow to its destination. The arrow may strike a hard object or become buried under brush or snow. Arrow performance is also affected by the weight of the arrow inasmuch as arrow velocity varies inversely with arrow mass. The present invention includes a lightweight, simplified and improved tail lighting system carried internally within the arrow to remedy the above difficulties. Consequently, it is evident that a lighted nock minimizing the addition of weight to the arrow would be most preferred by archery hunters.

2. Prior Art

The idea of illuminating an arrow nock is not new, as evidenced by a review of prior U.S. patents. However, the preferred embodiment of the present invention constitutes significant and useful improvements over the illuminated arrow nocks of the prior art that will now be briefly reviewed.

U.S. Pat. No. 6,390,642 This invention uses a magnet separately mounted on the bow to activate the light switch. Additional circuitry is also required to regulate power to the light.

U.S. Pat. No. 4,340,930 This invention uses a manual operated slide switch to illuminate the light source. With this arrangement, the light must be manually turned on prior to the shooting of the arrow. This system would create a disadvantage and frighten game animals in hunting situations.

U.S. Pat. No. 5,058,900 Discloses a general-purpose illuminator assembly using an L.E.D light source that responds to acceleration and deceleration of the housing structure to turn the light source on and off. Unlike the present invention this design would turn off upon striking a hard surface like a rock, tree, or bone of a game animal therefore losing the ability to track game and to locate the shot arrow.

U.S. Pat. No. 5,134,552 Displays an overly complex method of illuminating an arrow nock. This invention although unique, severely reduces arrow speed do to its exceptionally heavy weight. Furthermore, do to the deceleration properties of this device it would turn off if shot arrow were to come in contact with a solid object such as a tree, rock, or bone of a hunted animal.

U.S. Pat. No. 6,364,499 This apparatus requires a nock protective cap.

The disadvantage to this system is the protected cap could become dislodged therefore draining the battery. Another disadvantage is the external contacts of the switch could become clogged with non-conductive material such as leaves or dirt when striking the forest floor. This could also happen when the arrow passes through a game animal such as a deer, which could clog the contacts with hair or bone. The present invention has addressed this concern and remedied this problem.

OBJECTS AND ADVANTAGES

Accordingly, the object of the present invention is to provide an illuminated arrow nock or insert that can be turned on by the act of shooting the arrow from a traditional bow, compound bow, and or crossbows.

Second object of the present invention is to provide a new and simplified method of arranging needed components to reduce weight.

Another object of the present invention is to provide an illuminated nock that will remain in the on or "closed switch" position when striking a solid object.

Also another object of the present invention is to provide a much-needed lighted nock that will remain lit even if dislodged from the arrow shaft.

Also another object of the present invention is to provide a lighted nock that is weatherproof.

Another object is to have a single anchor pin to attach all electrical components to the nock.

Not only does this present invention address the lighted assembly of the nock but an obviously new and useful way of joining its components in a lightweight configuration.

SUMMARY

The object of the present invention is to give the archer the advantages of visually tracking the arrow flight when shot from his or her bow in low light conditions while hunting. The arrow may strike a hard object or become buried under brush or snow and still remain in the lighted position. The present invention includes a lightweight, simplified and improved tail lighting system carried internally within the arrow shaft to remedy the above difficulties.

LEGENDS OF DRAWINGS

1—Nock
2—Battery
3—End Cap
4—Short Dowel
5—Long Dowel

6—Tubular Arrow Shaft
7—Fletching
8—Point
9—Target
10—String
11—Arrow Trajectory
12—Bow
13—Arrow with attached point/tubular shaft/and fletching.
21—Collar
23—Anchor Pin
24—L.E.D light bulb
25—Battery/Switch/Collar in "closed switch" position
26—Battery/Switch/Collar in "open switch" position
400—Center Line Through present invention

DETAILED DESCRIPTION OF INVENTION

In the description of this invention the words "closed switch" is to indicate the circuit is energized to the LED light bulb. "Open switch" is to indicate the circuit is not energized to the LED light bulb.

In the description of this invention the words "anchor pin" indicates a pin made of metal or plastic used to hold or capture said components in a fixed position.

In the description of this invention the words "dowel" identifies a material made from wood, plastic, or carbon placed inside arrow shaft as a means of limiting forward travel of assembly.

While the embodiment of the present invention may have a broad scope of uses its premiere application is in conjunction with a lighted arrow nock.

Figure 1:
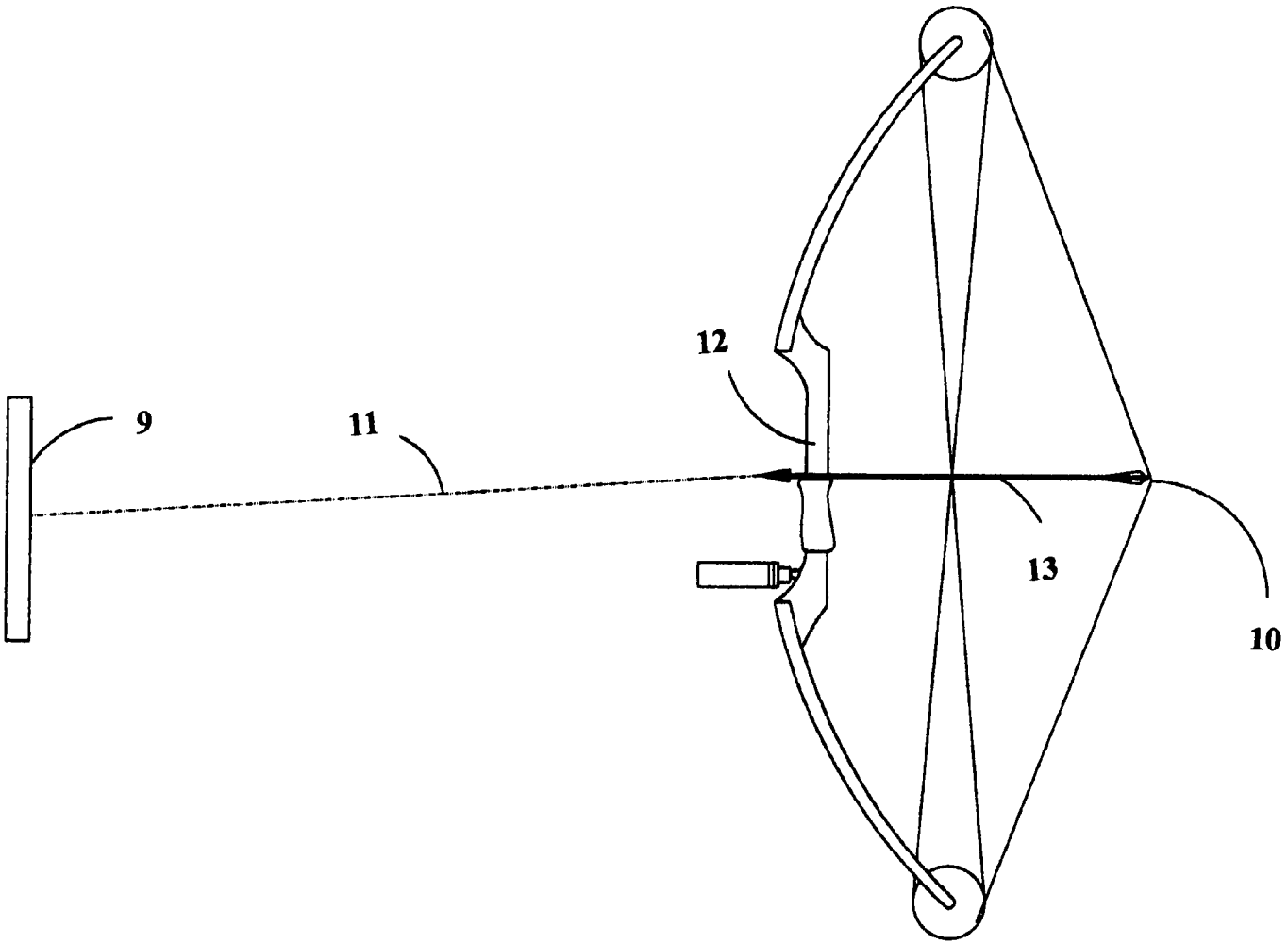
FIG. 1—Side view of Bow, Arrow and arrow trajectory.

FIG. 1. There is shown a side view of bow 12 in full drawn position and furthermost rearward section of string 10, reference is made to FIG. 2 to better show the relationship of applied components.

The arrow trajectory 11 shows forward path taken buy arrow 13 to target 9 when shot from bow 12.

Figure 2:
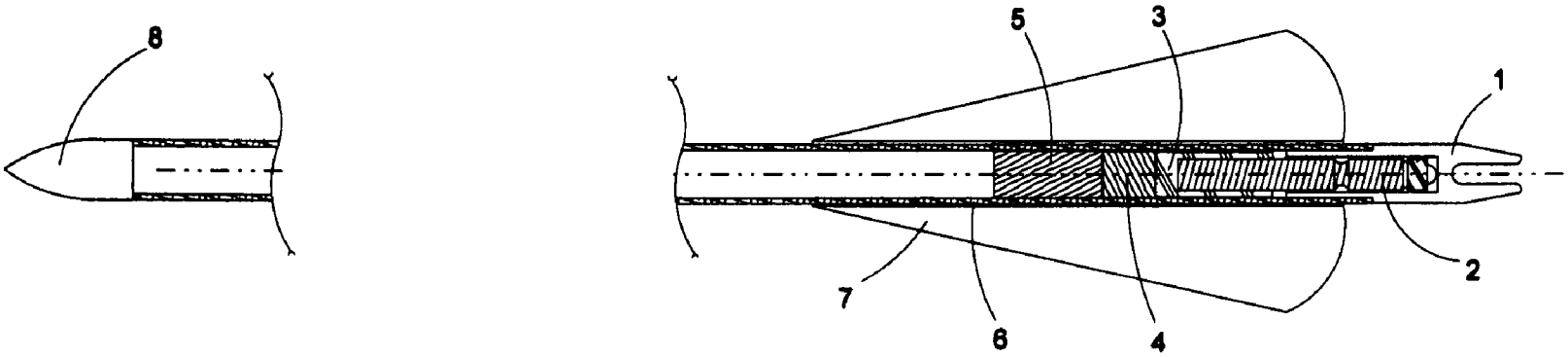
FIG. 2—Sectional view of rearward section of arrow shaft including fletching and assembled lighted nock.
Figure 3:
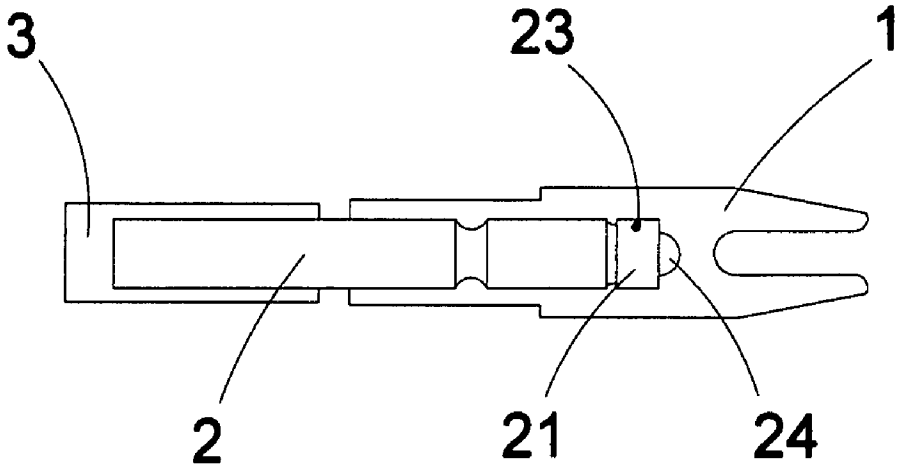
FIG. 3—Side View of lighted nock with its combined components.
Figure 5:
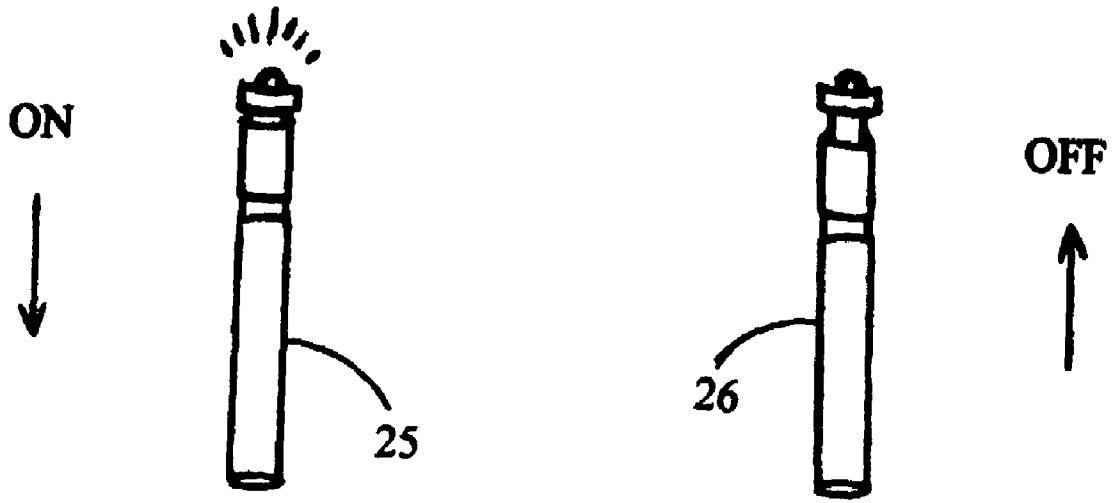
FIG. 5—Side View of Battery/Switch/Collar/LED Assembly

FIG. 2. Sectional view shows the preferred embodiment of this invention. The point 8 represents the forward end of tubular arrow shaft 6. While reference is made to FIG. 3 to better shows the relationship of lighted nock installed in tubular arrow shaft 6. FIG. 2 also shows fletching 7 made generally of plastics or natural feathers used by manufactures to stabilize the arrow in flight. This drawing also shows commercially available battery 2 collar 21 LED 24 with internal single pole switch as a combined unit located in counter bore of nock 1 and end cap 3 along with short dowel 4 and long dowel 5 installed in tubular arrow shaft 6. Short dowel 4 and long dowel 5 can also be permanently installed in the arrow shaft during manufacturing. FIG. 3 Side view depicts the preferred embodied method of arrangement of the present invention and its components minus said short dowel 4 and long dowel 5. The nock 1 is available in many variations, colors, and materials including plastics and is commercially available from most archery supply companies. Battery 2 collar 21 and LED 24 with its internal single pole switch are manufactured and sold as a "combined unit" also available from most archery supply companies. Reference is made to FIG. 5 to better understand the configuration of this combination of components. End cap 3 is made from a medium dense plastic. This end cap is used to absorb unwanted forward energy created by the release of the bowstring 10. This prevents damage to the battery by creating a cushion effect along with adding protection and structural support of the batteries fragile thin wall aluminum construction.

Figure 4:
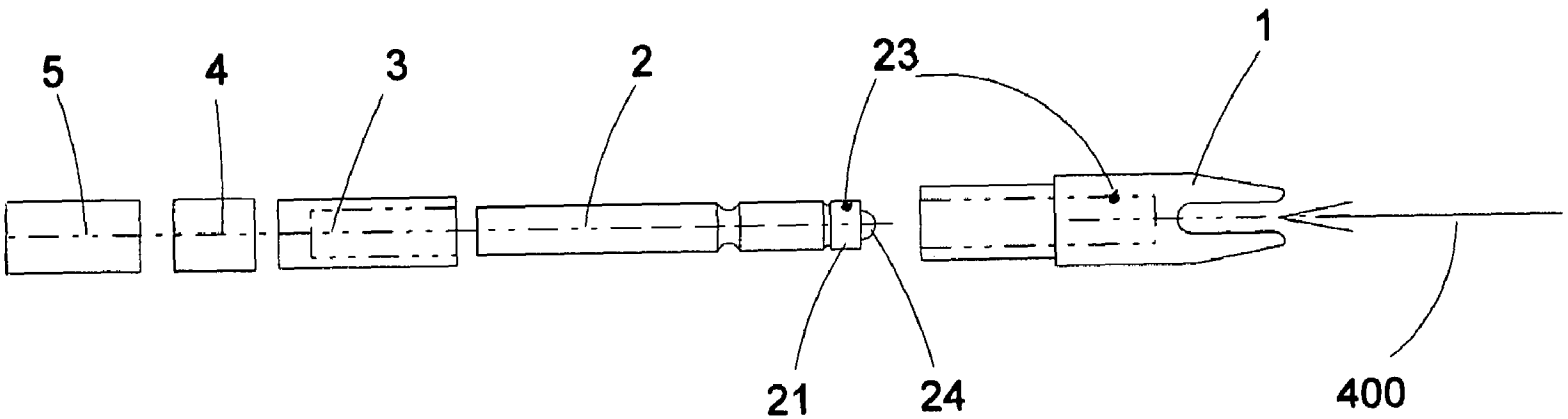
FIG. 4—Exploded view of present invention with all needed components.

FIG. 4 is an exploded view showing centerline 400 of the present invention. Nock 1 showing counter bore for inserting battery 2, collar 21, switch and LED 24. Reference is made to FIG. 3 to better illustrate the final resting place of each component. Battery 2 collar 21 and switch LED 24 are positioned into nock 1. Secondly a hole is drilled through nock 1 and collar 21 to capture both nock 1 and combined battery/collar/switch/LED. Anchor pin 23 is then inserted through nock 1 and passing through collar 21 to secure battery 2 including collar 21 and LED 24 with its internal single pole switch as a "combined unit" in a fixed and permanent position within said nock 1. End cap 3 is then inserted over battery 2 and glued into position. This new method of configuring components and using a single anchor pin 23 in the present invention also creates a lightweight and weatherproof-lighted nock assembly when installed in a commercially available tubular arrow shaft. Reference is made to FIG. 2 to further understand the following step. Short dowel 4 and long dowel 5 are inserted and glued into tubular arrow shaft 6 in FIG. 2.

FIG. 5 Illustrates the Battery/Collar/LED/Switch combined unit referenced to earlier. Note that 25 shows assembly in the on or "closed switch" position and 26 shows the same assembly in the off or "open switch" position. The difference in length between 25 and 26 is due to the positive locking on-off plunger type switch installed in this assembly by the manufacturer.

By reviewing the above drawings a person will notice that this fully assembled invention can be turned on and off simply by pushing and pulling on end cap 3 while holding nock 1 in a stationary position. Therefore the movement allowed by the switch can be redirected to the rear of said assembled lighted nock. When inserting long dowel 5 and short dowel 4 of the present invention in a tubular arrow shaft 6 along with the lighted nock of the present invention in the on or "closed switch" position, long dowel 5 and short dowel 4 being seated up against end cap 3 with nock 1 fully inserted and seated up against tubular arrow shaft 6. A person then can remove said lighted nock assembly while leaving short dowel 4 and long dowel 5 now glued in a permanent position inside tubular arrow shaft 6. Lighted nock of the present invention will then stay lit or in the "closed switch" position even though the assembly is removed from tubular arrow shaft 6. Also with this configuration the lighted nock can strike a solid object and still remain in the on or "closed switch" mode. Do to the forward movement of said components being restricted by the permanently glued fixed position of short dowel 4 and long dowel 5. To reuse this present invention a person need only re-insert the lighted nock back into shaft and leave a 1–2 millimeter gap between the lighted nock assembly and the rearward most end of the arrow shaft, also with this invention a fresh lighted nock assembly can be quickly inserted into the arrow shaft without having to reinstall short dowel 4 and long dowel 5 making it renewable and useful in hunting situations. Upon release of the arrow from bow 12 the forward motion and pressure created by the bowstring 10 will then compress the lighted nocks components 1–2 millimeters in the forward direction and turn said lighted assembly to the on or "closed switch" position therefore energizing the LED bulb to give off light through the translucent or clear nock. When this invention is shot from a bow and compressed in the "closed switch" position, the nock 1 being pressed into said shaft 6 creates a friction fit therefore also creating a weather-proof cavity with all said electrical components inside arrow shaft away from rain, snow.

What is claimed is:

1. An illuminated arrow nock installed in a bore of a tubular arrow shaft comprising:

a light diffusing translucent or clear archery arrow nock; a dowel or bushing embedded inside tubular arrow shaft; a battery; an LED lamp; an end cap; a single pole switch; an anchor pin; and a hole in said nock to accept said anchor pin;

wherein a round dowel or bushing having a same diameter as the inside of the tubular arrow shaft is permanently embedded inside said tubular arrow shaft to restrict all forward movement of said nock and battery within the tubular arrow shaft.

2. An illuminated arrow nock installed in a bore of a tubular arrow shaft comprising:

a light diffusing translucent or clear archery arrow nock; a dowel or bushing embedded inside tubular arrow shaft; a battery; an LED lamp; an end cap; a single pole switch; an anchor pin; and a hole in said nock to accept said anchor pin;

wherein a plastic end cap is bored a same diameter as the outside diameter of the battery, thereby allowing the end cap to be installed over the battery and positioned at a rearward most portion of said battery to further align and cushion the battery and nock.

* * * * *